US011085228B2

(12) United States Patent
Albrecht

(10) Patent No.: US 11,085,228 B2
(45) Date of Patent: Aug. 10, 2021

(54) WINDOW SYSTEM WITH INTERCHANGEABLE EXTERIOR ACCESSORY COVERS

(71) Applicant: Sierra Pacific Industries, Anderson, CA (US)

(72) Inventor: Scott D. Albrecht, Merrill, WI (US)

(73) Assignee: Sierra Pacific Industries, Anderson, CA (US)

( * ) Notice: Subject to any disclaimer, the term of this patent is extended or adjusted under 35 U.S.C. 154(b) by 0 days.

(21) Appl. No.: 16/400,810

(22) Filed: May 1, 2019

(65) Prior Publication Data

US 2019/0257136 A1 Aug. 22, 2019

Related U.S. Application Data

(63) Continuation of application No. 14/838,798, filed on Aug. 28, 2015, now Pat. No. 10,337,233.

(60) Provisional application No. 62/043,927, filed on Aug. 29, 2014.

(51) Int. Cl.
*E06B 1/36* (2006.01)
*E06B 1/60* (2006.01)

(52) U.S. Cl.
CPC . *E06B 1/36* (2013.01); *E06B 1/60* (2013.01)

(58) Field of Classification Search
CPC ..... E06B 1/02; E06B 1/04; E06B 1/12; E06B 1/34; E06B 1/342; E06B 1/345; E06B 1/36; E06B 1/56; E06B 1/60; E06B 1/6015; E06B 1/6023; E06B 1/6038; E06B 1/70; E06B 1/702; E06B 1/705
See application file for complete search history.

(56) References Cited

U.S. PATENT DOCUMENTS 3,918,228 A * 11/1975 LaBorde ..... E06B 1/342 52/288.1
4,240,765 A ‡ 12/1980 Offterdinger ..... E06B 3/9765 29/897
4,254,583 A ‡ 3/1981 Smits ..... E06B 3/325 49/246

(Continued)

FOREIGN PATENT DOCUMENTS

CA 2 343 865 ‡ 7/2006
CA 2343865 7/2006

*Primary Examiner* — Jessica L Laux
(74) *Attorney, Agent, or Firm* — Merchant & Gould P.C.

(57) ABSTRACT

Window assemblies and methods for making window assemblies are disclosed herein. In one aspect, the window assembly can include a base frame assembly, an accessory support frame assembly, and an exterior accessory frame assembly. The base frame assembly is connected to and supported by the accessory support frame. The accessory support frame can be attached to a building structure via a first plurality of fasteners. The exterior accessory frame assembly, which provides much of the exterior aesthetic appearance of the window assembly, can be connected to the accessory support frame via a second plurality of fasteners which are concealed from view by the exterior accessory frame. In one example, the accessory members conceal the first plurality of fasteners once the exterior accessory assembly is connected to the base frame assembly. Many different styles of exterior accessory frames can be supported by the accessory support frame.

18 Claims, 12 Drawing Sheets

(56) References Cited

U.S. PATENT DOCUMENTS 4,328,644 A ‡ 5/1982 Scott ..... E06B 3/302 49/501
4,443,984 A * 4/1984 Rasmussen ..... E06B 1/34 52/211
4,837,977 A ‡ 6/1989 Mauro ..... E06B 3/303 49/501
5,553,420 A ‡ 9/1996 Klimek ..... E05C 9/02 49/394
6,044,611 A ‡ 4/2000 Brunett ..... E06B 1/6015 16/389
6,055,782 A ‡ 5/2000 Morton ..... E06B 1/30 49/504
6,321,494 B1 ‡ 11/2001 Oberg
6,745,523 B2 ‡ 6/2004 Petta ..... E06B 1/34 52/213
6,992,958 B2 ‡ 1/2006 Kudo et al.
7,073,292 B1 ‡ 7/2006 Minter ..... E05B 65/0876 160/38
7,150,130 B2 ‡ 12/2006 Kobayashi et al.
7,340,866 B1 * 3/2008 Smith ..... E06B 1/003 52/204.54
7,510,130 B2 3/2009 Inoue
7,552,562 B2 ‡ 6/2009 Curtis ..... E06B 3/44 49/414
7,631,465 B2 ‡ 12/2009 Curtis ..... E06B 3/4609 52/204.1
8,561,365 B2 ‡ 10/2013 Albrecht et al. .... E05B 63/0052 52/204.5
8,813,442 B1 ‡ 8/2014 Edwards et al. ..... E06B 3/549 52/204.5
2003/0079414 A1 ‡ 5/2003 Rangabasyam et al.
2003/0126812 A1 ‡ 7/2003 Folsom et al. ..... E06B 1/345 52/204.62
2004/0003553 A1 ‡ 1/2004 Donoghue ..... E06B 1/325 52/204.5
2004/0118050 A1 ‡ 6/2004 Liu
2004/0211132 A1 ‡ 10/2004 Petta ..... E06B 1/62 52/204
2005/0016073 A1 ‡ 1/2005 Petta ..... E05C 9/02 49/504
2005/0183351 A1 * 8/2005 Brunnhofer ..... E06B 3/26305 52/204.5
2007/0011948 A1 ‡ 1/2007 Rangabasyam ..... E05C 9/02 49/395
2007/0137119 A1 ‡ 6/2007 Guillemette ..... E06B 3/306 52/204
2008/0196342 A1 ‡ 8/2008 Franklin ..... E06B 3/26341 52/309
2013/0091776 A1 ‡ 4/2013 Van Camp et al. ..... E06B 1/70 49/467
2013/0263536 A1 ‡ 10/2013 Peck et al. ..... E06B 1/34 52/211

* cited by examiner
‡ imported from a related application

WINDOW SYSTEM WITH INTERCHANGEABLE EXTERIOR ACCESSORY COVERS

CROSS REFERENCE TO RELATED APPLICATION

This application is a continuation application of U.S. Ser. No. 14/838,798, filed Aug. 28, 2015. U.S. Ser. No. 14/838,798 claims the benefit of U.S. Provisional Application No. 62/043,927, filed Aug. 29, 2014. The disclosures of U.S. Ser. No. 14/838,798 and U.S. Provisional Application No. 62/043,927 are hereby incorporated herein by reference.

TECHNICAL FIELD

This disclosure relates generally to window assemblies, and methods of constructing window assemblies.

BACKGROUND

Window assemblies have historically been fabricated with a structural base frame, a sash frame that holds one or more glass panes, an exterior accessory frame, and various trim pieces. The base frame is the portion of the window assembly which is attached to the structure of the building. The sash frame is the portion of the window assembly which holds the window pane and fits within the base frame. The exterior accessory frame is the exterior portion of the window assembly that defines the exterior aesthetic appearance of the window assembly and provides for weather protection. Some window assemblies require that the base frame be uniquely designed to match a particular exterior accessory frame. Some window assemblies require that the exterior accessory frame be connected to the building structure and to the base frame. Improvements are desired.

SUMMARY

Window assemblies and methods for making window assemblies are disclosed herein. In one aspect, the window assembly can include a base frame assembly, an accessory support frame assembly, and an exterior accessory frame assembly. The base frame assembly can include a plurality of base frame members that form a frame that supports at least one window pane. The accessory support frame assembly can be connected to the base frame assembly and can be attached to a wall structure via a first plurality of fasteners such that the accessory support frame supports the base frame. The exterior accessory frame assembly can include a plurality of accessory members that form a frame. Each of the accessory members can be connected to the base frame assembly via a second plurality of fasteners. In one example, the accessory members conceal the first plurality of fasteners once the exterior accessory assembly is connected to the base frame assembly.

In one example, a modular window assembly kit is provided, wherein the accessory support frame is defined as having an interior portion and an exterior portion. In one aspect, a first mounting feature is provided and located proximate the interior portion of the accessory support frame, wherein the first mounting feature connects the accessory support frame to the building structure. The kit can also include a plurality of exterior accessory frame assemblies, wherein an exterior profile of each exterior accessory frame assembly is different from at least one other exterior accessory frame assembly exterior profile. A second mounting feature can also be provided and located proximate the exterior portion of the base frame assembly, wherein the second mounting feature is constructed and arranged to connect the accessory support frame assembly to one of the plurality of exterior accessory frame assemblies.

A method of installing a window assembly is also described herein. One step of the method can include providing a base frame assembly including a plurality of base frame members that form a frame retaining at least one window pane. Another step can be providing an accessory support frame and connecting the accessory support frame to the base frame. The assembled base frame and accessory support frame can then be inserted into an opening in the wall of a building structure. The assembly can be attached to the building structure via a first plurality of fasteners that are engaged with the accessory support frame. In one example, the base frame assembly is not directly attached to the building structure with fasteners or by other means. In yet another step, an exterior accessory frame assembly is selected, wherein the exterior accessory frame assembly includes a plurality of accessory members that form a frame. The method can also include attaching the exterior accessory frame assembly to the accessory support frame via a second plurality of fasteners such that the exterior accessory assembly conceals the first plurality of fasteners once the exterior accessory assembly is connected to the base frame assembly.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
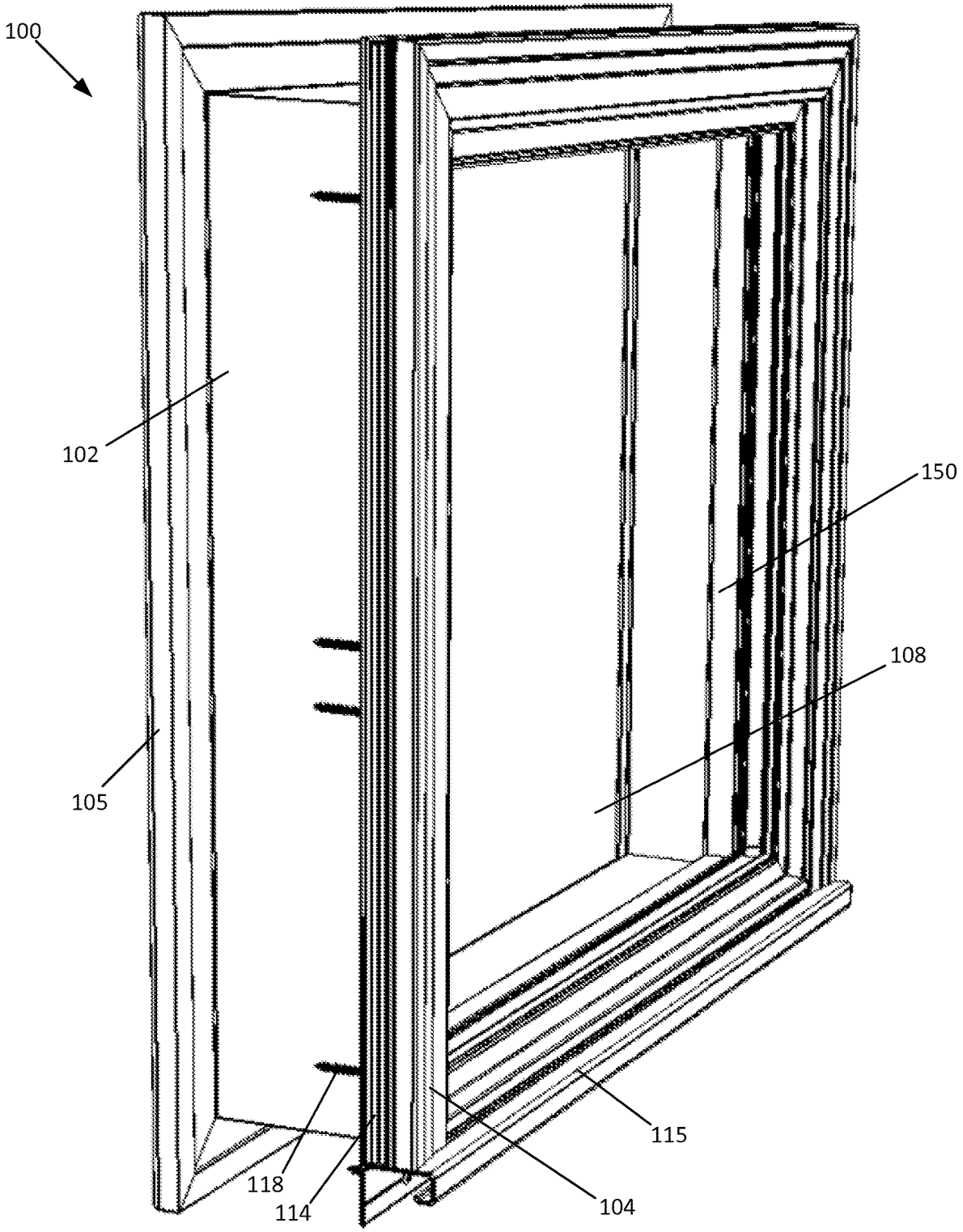
FIG. 1 is a perspective view of a window assembly having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

For the purpose of general illustration, FIG. 1 shows a window assembly 100 having a base frame assembly 102, a sash frame assembly 150 holding one or more window panes 108, and an interior trim assembly 105, as explained in detail below.

One aspect of the disclosure is base frame assembly 102. Base frame assembly 102 is the portion of window assembly 100 that is inserted into an opening of a wall in a building or other structure 10. The base frame assembly 102 provides the primary structural support for window assembly 100 and additionally provides a platform to which the other components of window assembly 100 can be mounted. As shown in FIG. 1, base frame assembly 102 defines a frame having the shape of a rectangle or square from four base frame members. Other shapes are possible. For some types of windows, each of the four base frame members 102 may be cut from a common base frame member stock such that they all have the same cross-sectional profile. Further, base frame member stock segments can be produced in lineal fashion such that many base frame members can be cut from a single length of stock. Thus, where applicable, the use a single lineal profile for all of the base frame members 102 results in a reduction of frame part types, part machining and assembly time. The base frame members 102 may be constructed from many materials, such as wood and extrudeable, pultrudeable or roll formed materials, including but not limited to aluminum, steel alloys, polyolefin polymers, cellular PVC (polyvinyl chloride or vinyl) polymers, cellulosic plastic composites, fiberglass composites, polymeric alloys or other extrudeable, pultrudeable and formable material. It is noted that other configurations for the base frame assembly 102 may be utilized without departing from the concepts herein.

The window assembly 100 can also be provided with a sash or glass stop assembly 150 for securing a window pane 108 within the window assembly 100. In one example, the sash assembly is fixed with respect to the base frame assembly 102 such that the window is fixed or non-operable. In one example, the sash assembly 150 is provided as a moveable assembly that enables the window assembly 100 to be opened to the outdoors, where desired.

The sash assembly 150 can include an interior sash frame assembly 106 and an exterior sash frame assembly 110 are provided that cooperate with the base frame assembly 102 to secure the window pane 108. The interior sash frame assembly 108 is formed from individual frame members while the exterior sash frame assembly 110 is formed from individual frame members. As shown, the interior sash frame members are secured to corresponding base frame members 102 by fasteners, such as nails or screws. The exterior sash frame members are also secured to the corresponding base frame members 102 by fasteners 112, such as by screws 112. It is noted that other configurations for the sash assembly may be utilized without departing from the concepts herein.

The window assembly 100 may also be provided with an accessory support frame assembly 114 formed from individual frame members that form the frame assembly 114. In one embodiment, and as shown at FIG. 1, the accessory support frame assembly 114 can include three frame members which form a frame with a structural sill nose 115 at the bottom of the window assembly 100. However, a sill nose 115 is not required for all applications and a frame can be formed entirely from the support frame members 114. For ease of reference, the frame members of the accessory support frame assembly 114 and sill nose 115 can be referred to herein as a frame member 114*x*. The accessory support frame assembly 114 is for providing an installation base to support a variety of differently styled exterior accessory frame assemblies 104 that can be used depending upon application and the desired architectural style for the window assembly 100. As will be appreciated by one skilled in the art, the disclosed accessory support frame assembly 114 forms a portion of the exterior cladding of the window assembly 100.

Figure 2:
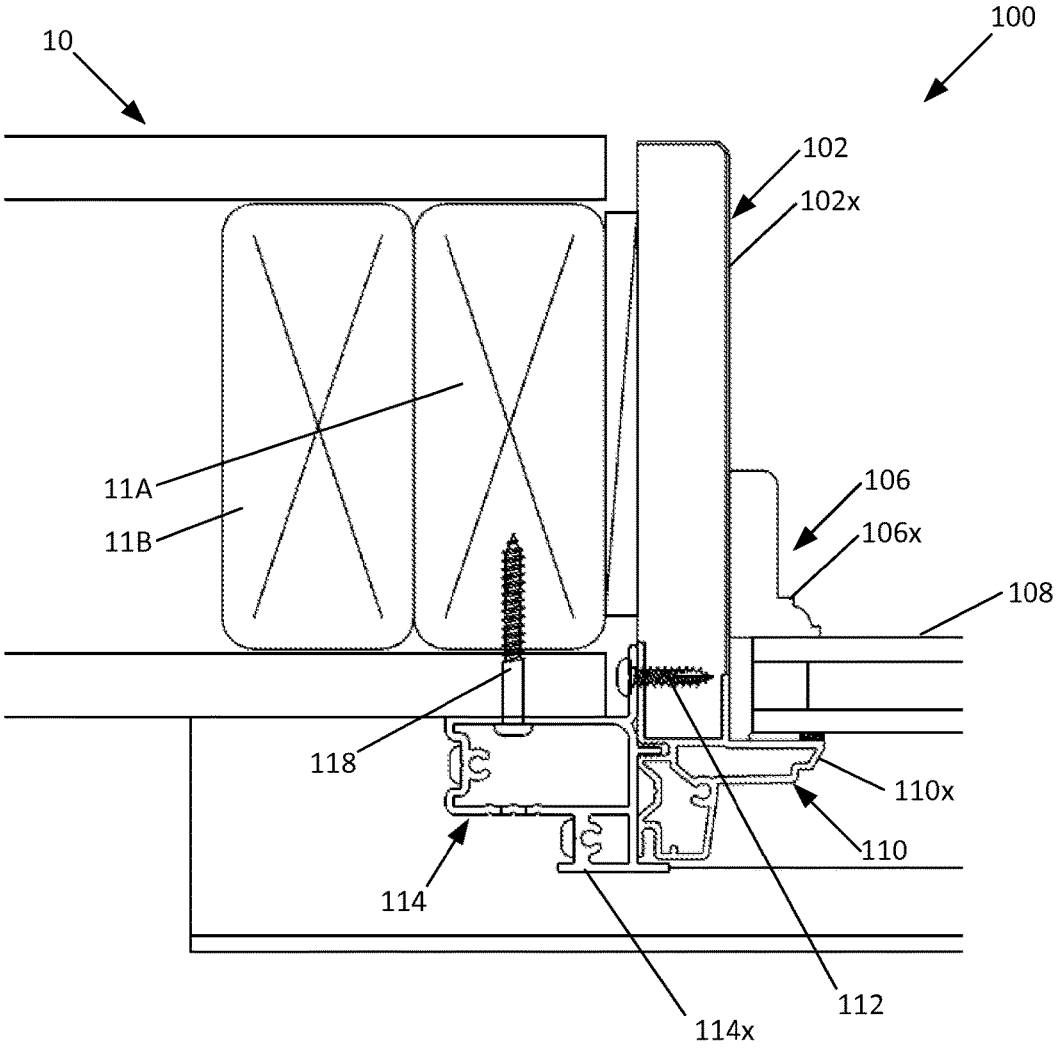
FIG. 2 is a cross-sectional view of the window assembly of FIG. 1 through the accessory support frame assembly and without an exterior accessory frame installed.
Figure 3:
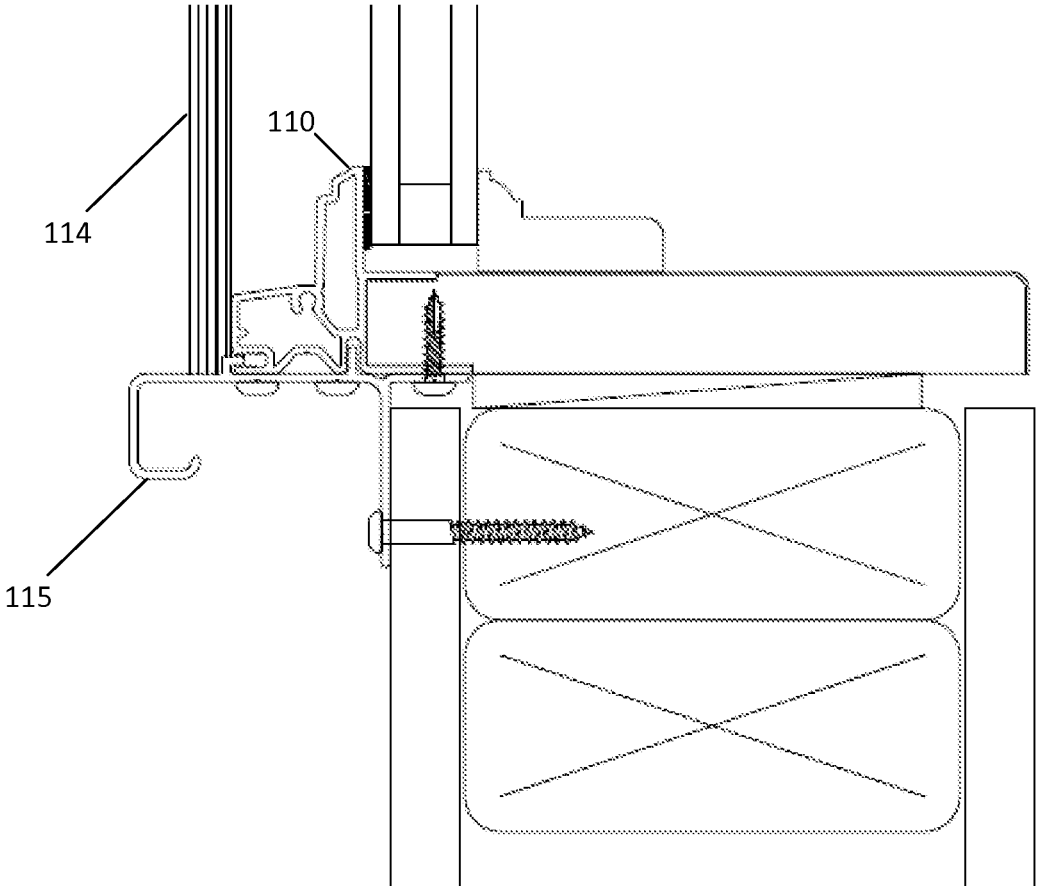
FIG. 3 is a cross-sectional view of the window assembly of FIG. 1 through the sill nose.

As most easily seen at FIGS. 2 and 3, the frame members 114*x* and sill nose 115 are attached to respective base frame members 102*x* via fasteners, such as screws 112. In one example, the frame members 114*x* are attached to the building structure 10 via fasteners 118, such as screws 118 extending into one or more studs 11A or 11B. In the embodiment shown, the frame members 114*x* and sill nose 115 are secured to both the base frame assembly 102 and the building structure 10 via a plurality of fasteners 112, 118, respectively. In one example, the fasteners 112 secure the base frame assembly 102 to the support frame assembly 114 and the fasteners 118 function to secure the entire window assembly 100 to the building structure 10. In such an example, the base frame assembly 102 can be further secured to the building structure 10 with additional fasteners. Alternatively, the base frame assembly 102 can rely completely on the connection to the support frame assembly 114 for structural support with no fasteners directly securing the base frame assembly 102 to the building structure 10. In one embodiment, the corresponding members of the base frame assembly 102 and the support frame assembly 114 are formed as singular, integral components such that fasteners 112 are not required.

Figure 4:
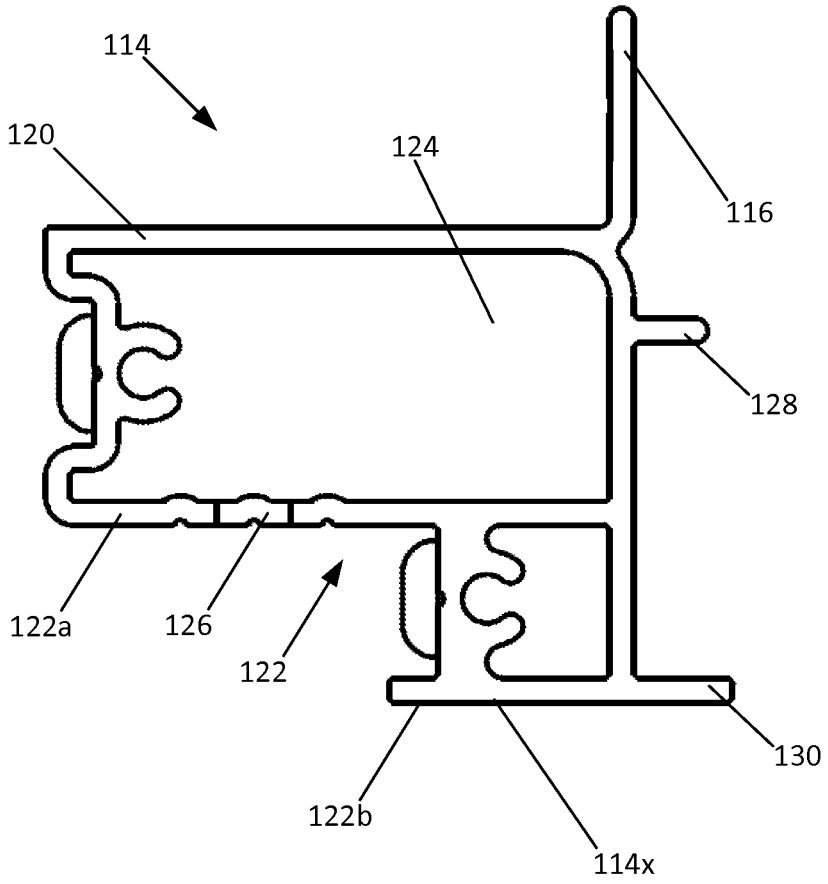
FIG. 4 is a cross-sectional view of the accessory support frame assembly of the window assembly shown in FIG. 1.

As most easily seen at FIG. 4, each of the frame members 114*x* has an interior portion 120 and an exterior portion 122 that are separated by an internal cavity 124. As shown, the interior portion 120 and fin 116 are adjacent to the building structure 10 and operate to align the support frame assembly 114 to the building structure 10. In one aspect, the exterior portion supports the exterior accessory frame assemblies 104. Fins 128 and 130 are also shown as being provided to aid in aligning and/or securing the support frame members 114*x* with the exterior sash frame members 110*x*.

In one aspect, the exterior portion 122 can be provided with a plurality of apertures 126. Apertures 126 can be configured to allow for fastener 118 to pass through the exterior portion 122 and into the internal cavity 124 of the frame members 114*x* such that the fasteners 118 can secure the interior portion 120 to the building structure 10. The interior portion 120 may also be provided with an aperture aligned with aperture 126 such that fastener 118 does not have to penetrate the interior portion 120 during installation. As explained further, the apertures 126 also provide a mounting location for fasteners 132 associated with the accessory frame 104, resulting in the fasteners 132 and fasteners 118 being aligned along a common longitudinal axis L. It is noted that any number of apertures 126 can be provided, for example a number of apertures that exceeds the number of fasteners 132 such that an installer can choose one of a number of regularly spaced apertures 126.

Figure 5:
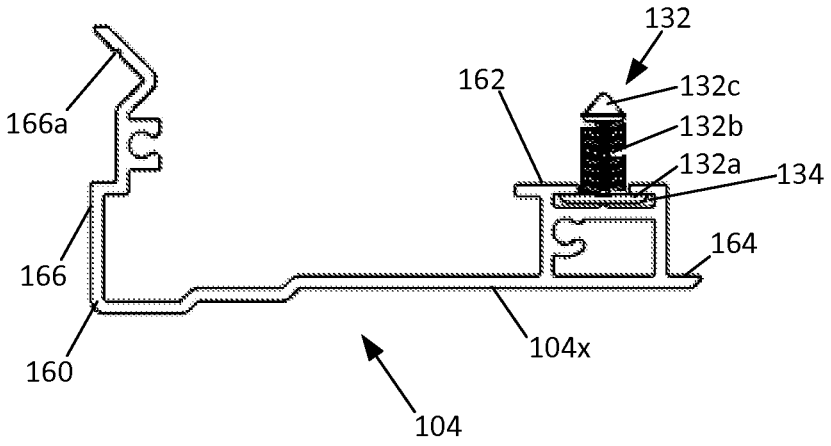
FIG. 5 is a cross-sectional view of a first exterior accessory frame assembly configured for attachment to the accessory support frame assembly of the window assembly shown in FIG. 1.
Figure 6:
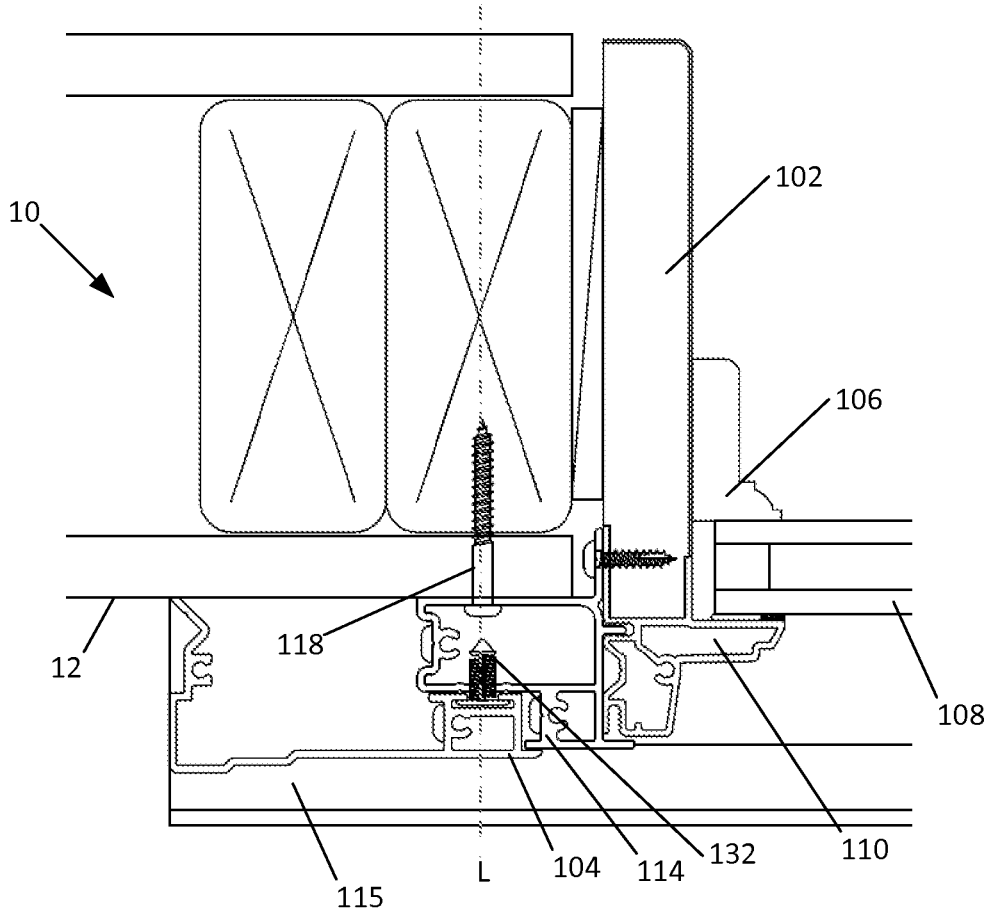
FIG. 6 is a cross-sectional view of the window assembly shown in FIG. 1 with the first exterior accessory frame of FIG. 5 installed.

Referring to FIGS. 5 and 6, a first example of an exterior accessory frame 104 is presented. As shown, accessory frame 104 can be mounted to the accessory support frame 114 to provide a durable and aesthetically pleasing exterior appearance for the window assembly 100. The accessory frame 104 may include a plurality of accessory members 104*x*. In one example, four accessory members 104*x* are provided that together form a rectangular or square frame. The accessory frame 104 may also include three accessory members 104*x*, and in conjunction with a structural sill nose 115, form a frame, as shown in FIG. 3.

Still referring to FIGS. 5 and 6, the accessory cover member 104*x* includes a main body 160 having an exterior surface 162 that can be used to form a 3½ inch frame with a stepped appearance. As shown, the main body 160 has first interior surface 162 that engages with a first surface 122*a* of the exterior portion 122 of the frame member 114*x*. The main body 106 has a second interior surface 164 that engages and overlaps with a second surface 122*b* of the exterior portion 122 of the frame member 114*x* to ensure a continuous exterior appearance between the frame member 114*x* and the cover member 104*x*. This configuration is advantageous as the window assembly 100 is designed such that both the frame members 114*x* and the cover members 104*x* are visible from the exterior, as are the exterior sash assembly members 110*x*. The main body also has a side edge portion 166 that engages with an exterior surface 12 of the building structure 10. In one aspect, the side edge portion 166 is provided with a canted portion 166*a* that aids in attachment of the accessory cover to the siding by placing a fastener through the cover wall in this area. Canted portion 166*a* also forms a pocket for fastener 119 to allow for brick or siding installation without interference from fastener 119 or a related flange.

Figure 5A:
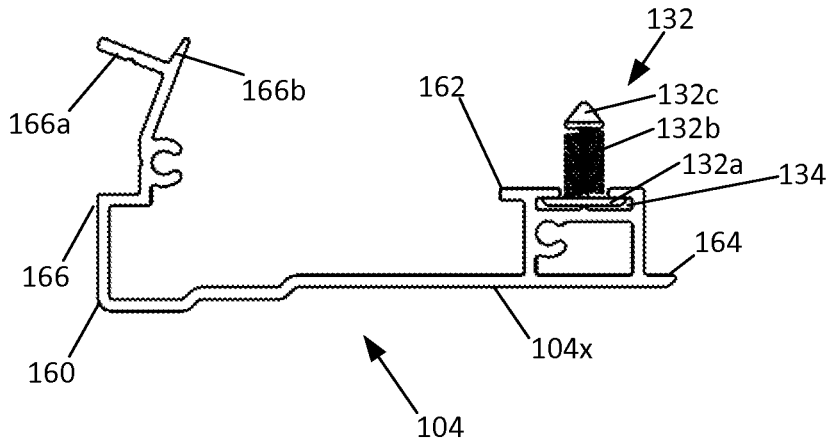
FIG. 5A is a cross-sectional view of an alternative arrangement of the first exterior accessory frame assembly shown in FIG. 5.
Figure 6A:
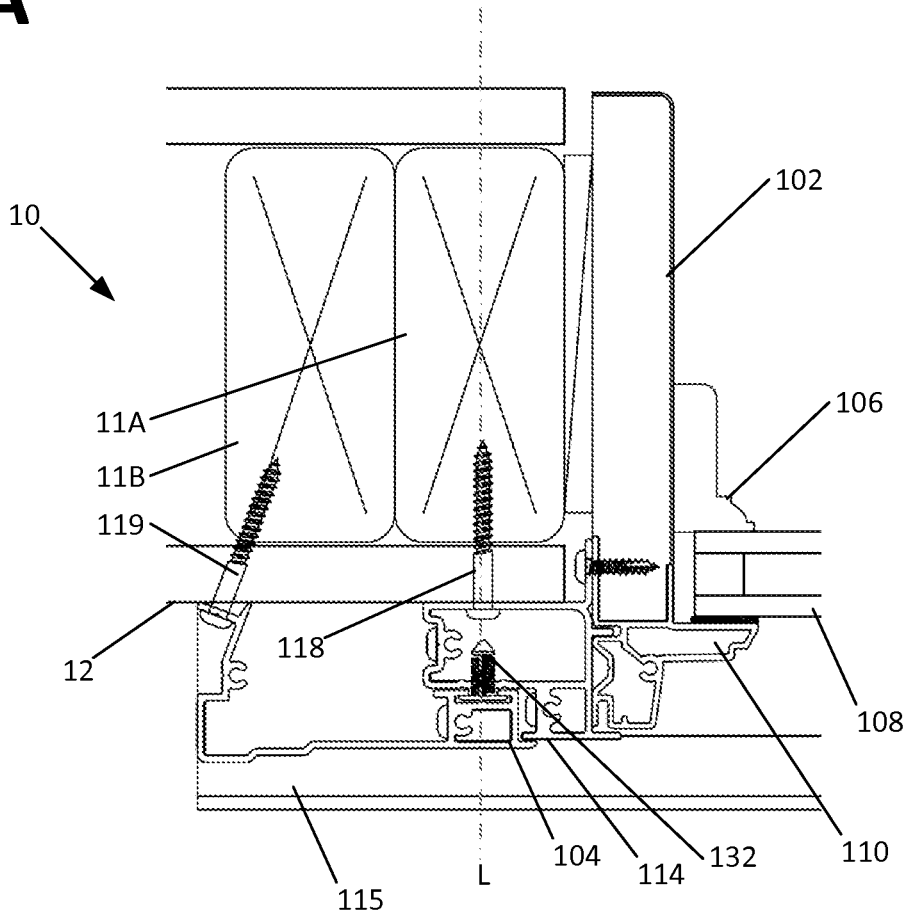
FIG. 6A is a cross-sectional view of the window assembly shown in FIG. 1 with the first exterior accessory frame of FIG. 5A installed.

Referring to FIGS. 5A and 6A, a slightly modified version of the accessory frame 104 is shown in which the main body side edge portion 166 is provided with a support leg 166*b* extending from the canted portion 166*a*. In this configuration, both the support leg 166*b* and canted portion 166*a* engage with the exterior surface 12 of the building structure 10 to support the side edge portion 166. This additional support more easily enables an additional fastener 119 to be installed through the canted portion 166*a* and into the stud 11B or another portion of the building structure 10. As can be readily seen at FIG. 6A, the fastener 119 is attached at an angle such that the fastener 119 is non-orthogonal to the exterior surface 12 and non-parallel to the fastener 118. This configuration allows for easier installation of the fastener 119 by providing a direct line of sight for a drill or screwdriver while also ensuring that the head of the fastener 119 is obscured by the main body when viewed directly from the front. It is noted that fastener 119 can also be used in the canted portion 166*a* for the configuration shown in FIGS. 5 and 6.

Figure 7:
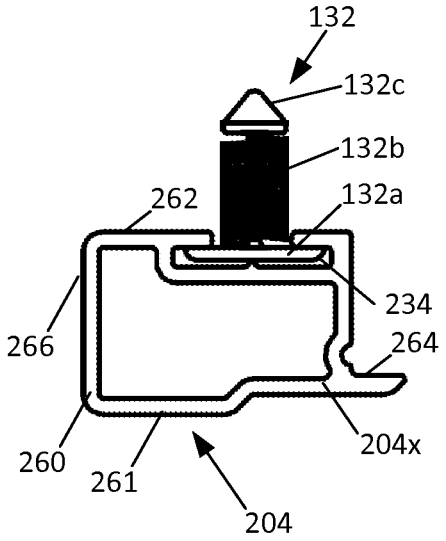
FIG. 7 is a cross-sectional view of a second exterior accessory frame assembly configured for attachment to the accessory support frame assembly of the window assembly shown in FIG. 1.
Figure 8:
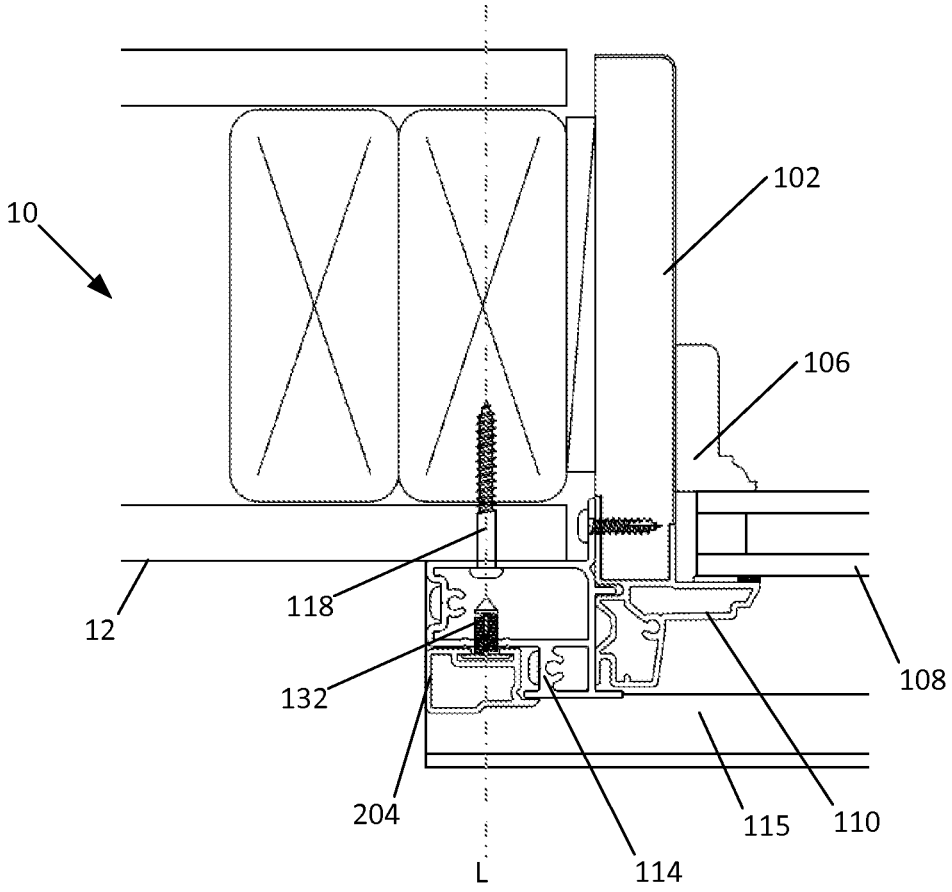
FIG. 8 is a cross-sectional view of the window assembly shown in FIG. 1 with the second exterior accessory frame of FIG. 7 installed.

Referring to FIGS. 7 and 8, a second example of an exterior accessory frame 204 is presented. As shown, accessory frame 204 can be mounted to the accessory support frame 114 to provide another option for a durable and aesthetically pleasing exterior appearance for the window assembly 100. It is noted that the accessory support frame 114 is the same as the frame 114 shown in FIG. 6, even though the profile of the accessory frame 204 is different from that for frame 104. As with frame 104, the accessory frame 204 may include a plurality of accessory members 204*x*. In one example, four accessory members 204*x* are provided that together form a rectangular or square frame. The accessory frame 204 may also include three accessory members 204*x*, and in conjunction with a structural sill nose 115, form a frame, similar to the configuration shown in FIG. 3. It is noted that accessory frame members 204 may also be bent or used with non-rectangular frames.

Still referring to FIGS. 7 and 8, the accessory cover member 204*x* includes a main body 260 having an exterior surface 261 that can be used to form a brick mould frame. As shown, the main body 260 has first interior surface 262 that engages with a first surface 122*a* of the exterior portion 122 of the frame member 114*x*. The main body has a second interior surface 264 that engages and overlaps with a second surface 222*b* of the exterior portion 122 of the frame member 114*x* to ensure a continuous exterior appearance between the base frame member 114*x* and the cover member 204*x*. This configuration is advantageous as the window assembly 100 is designed such that both the frame members 114*x* and the cover members 204*x* are visible from the exterior, as are the exterior sash assembly members 110*x*. The main body 206 also has a side edge portion 266 that is exposed or faces bricks or other facing materials of the building structure 10. It is noted that accessory frame members 204 may also be bent or used with non-rectangular frames.

Figure 8A:
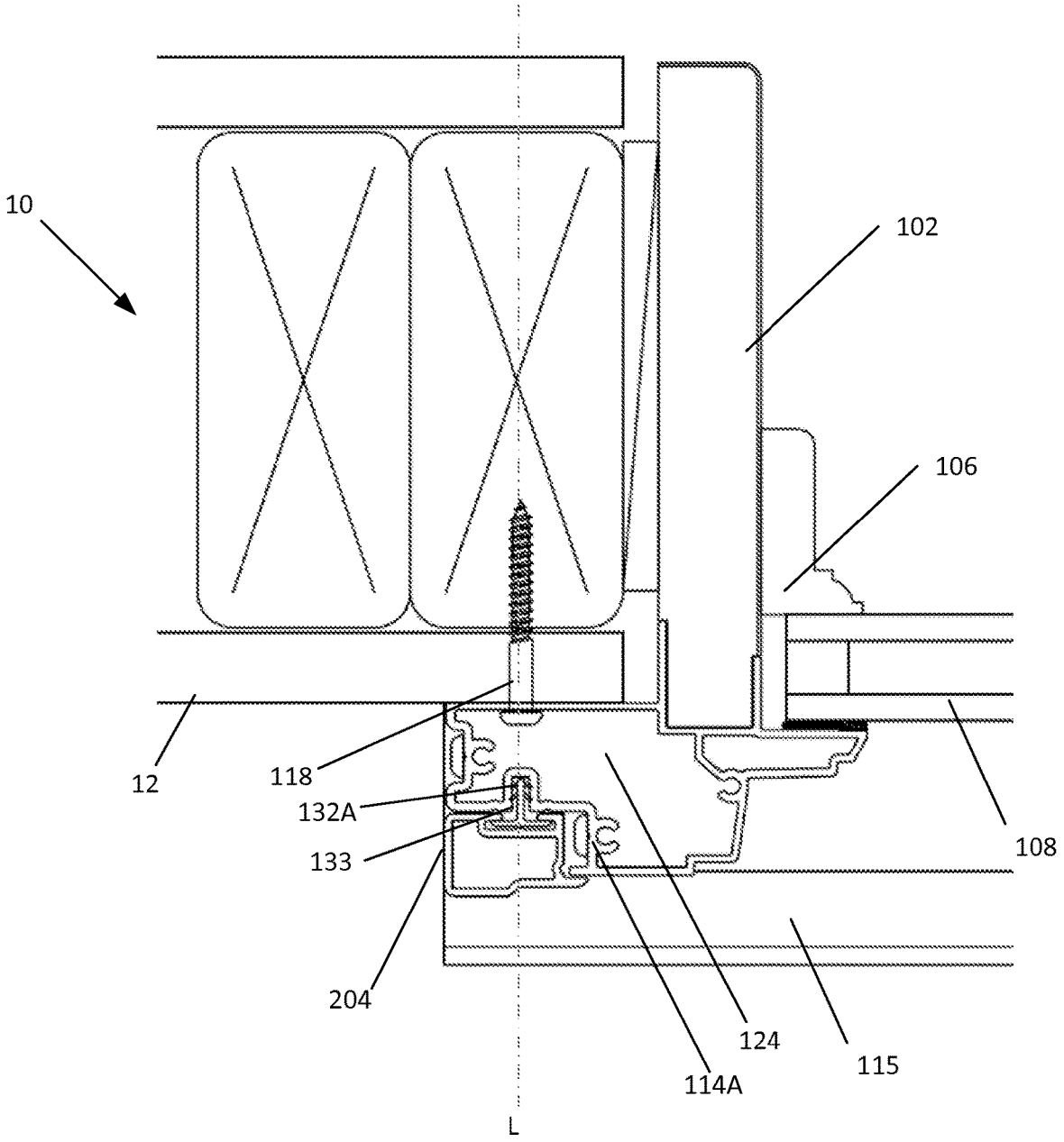
FIG. 8A is a cross-sectional view of the window assembly shown in FIG. 1 with a modified version of the assembly configuration shown in FIG. 8.

Referring to FIG. 8A, a modified version of the arrangement shown in FIGS. 7 and 8 is shown, wherein the accessory support frame members 114 are integrally formed with the exterior sash assembly frame members 110. In such an embodiment, the integrated structure can be referred to as an exterior support frame 114A. The exterior support frame 114A also differs in that the attachment mechanism by which the accessory frame 204 attaches to the exterior support frame 114A is changed to accept a barb-type fastener 132A. As shown, the exterior support frame 114A is provided with a channel 133 for receiving the fastener 132A, wherein the channel 133 does not create an opening into the interior space 124 of the frame 114A. Alternatively, the channel 133 can be open such that fasteners 118 can be installed through the opening. In the embodiment shown, an installer can simply drill a hole through the channel 133 in order to install a fastener 118. In such instances, the resulting hole will still be covered by the accessory frame 204, once installed.

Figure 8B:
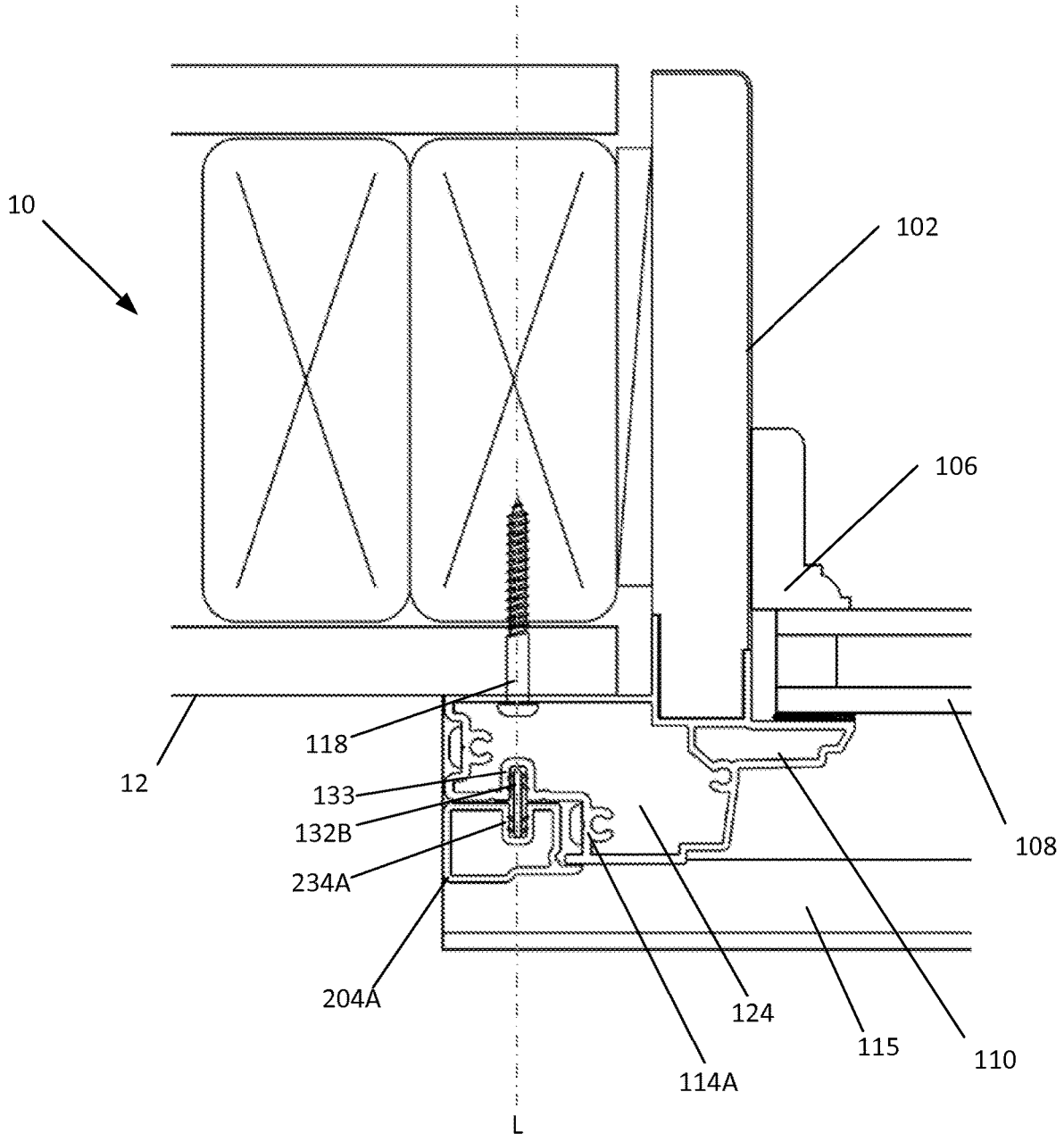
FIG. 8B is a cross-sectional view of the window assembly shown in FIG. 1 with a modified version of the assembly configuration shown in FIG. 8A.

Referring to FIG. 8B, a modified version of the arrangement shown in FIG. 8A is presented, wherein the members of the accessory frame 204 are provided with a different configuration of a channel 234A. As shown, the accessory frame 204 is provided with a channel 234A that is configured generally similarly to channel 133. In such an embodiment, a double barb-type fastener 234A can be used which extends between channels 133 and 234A to interconnect the frames 114A, 204A. As with the embodiment of FIG. 8A, an installer can drill a hole through the channel 133 in order to install the fastener, in this case fastener 132B. In such instances, the resulting hole will still be covered by the accessory frame 204A, once installed.

Figure 9:
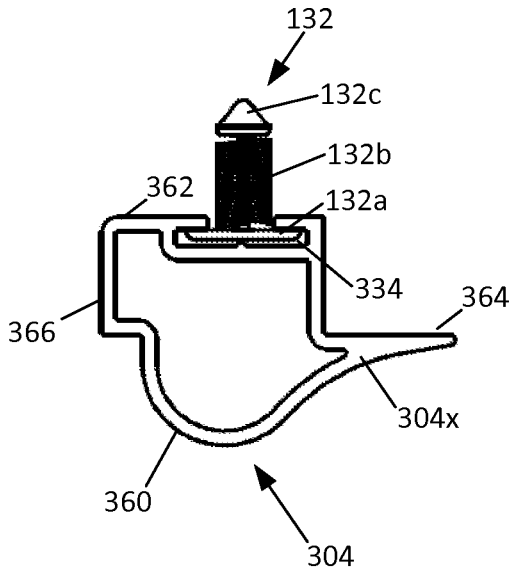
FIG. 9 is a cross-sectional view of a third exterior accessory frame assembly configured for attachment to the accessory support frame assembly of the window assembly shown in FIG. 1.
Figure 10:
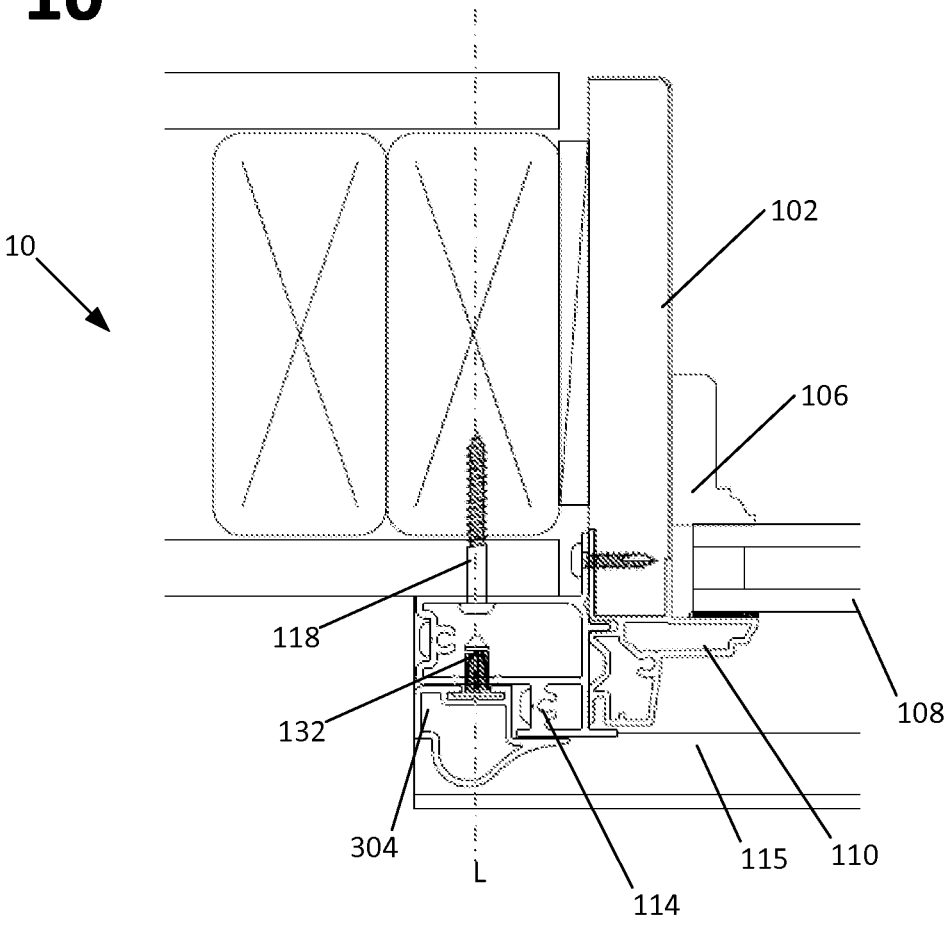
FIG. 10 is a cross-sectional view of the window assembly shown in FIG. 1 with the third exterior accessory frame of FIG. 9 installed.

Referring to FIGS. 9 and 10, a third example of an exterior accessory frame 304 is presented. As shown, accessory frame 304 can be mounted to the accessory support frame 114 to provide yet another option for a durable and aesthetically pleasing exterior appearance for the window assembly 100. It is noted that the accessory support frame 114 is the same as the frame 114 shown in FIGS. 6 and 8 even though the profile of the accessory frame 304 is different from that for frame 104. As with frame 104, the accessory frame 304 may include a plurality of accessory members 304*x*. In one example, four accessory members 304*x* are provided that together form a rectangular or square frame. The accessory frame 304 may also include three accessory members 304*x*, and in conjunction with a structural sill nose 115, form a frame, similar to the configuration shown in FIG. 3.

Still referring to FIGS. 9 and 10, the accessory cover member 304*x* includes a main body 360 having an exterior surface 362 that can be used to form a stylized frame. As shown, the main body 360 has first interior surface 362 that engages with a first surface 122*a* of the exterior portion 122 of the frame member 114*x*. The main body has a second interior surface 364 that engages and overlaps with a second surface 322*b* of the exterior portion 122 of the frame member 114*x* to ensure a continuous exterior appearance between the base frame member 114*x* and the cover member 304*x*. This configuration is advantageous as the window assembly 100 is designed such that both the frame members 314*x* and the cover members 304*x* are visible from the exterior, as are the exterior sash assembly members 110*x*. The main body 360 also has a side edge portion 366 that is either exposed or faces bricks or other facing materials of the building structure 10.

Figure 11:
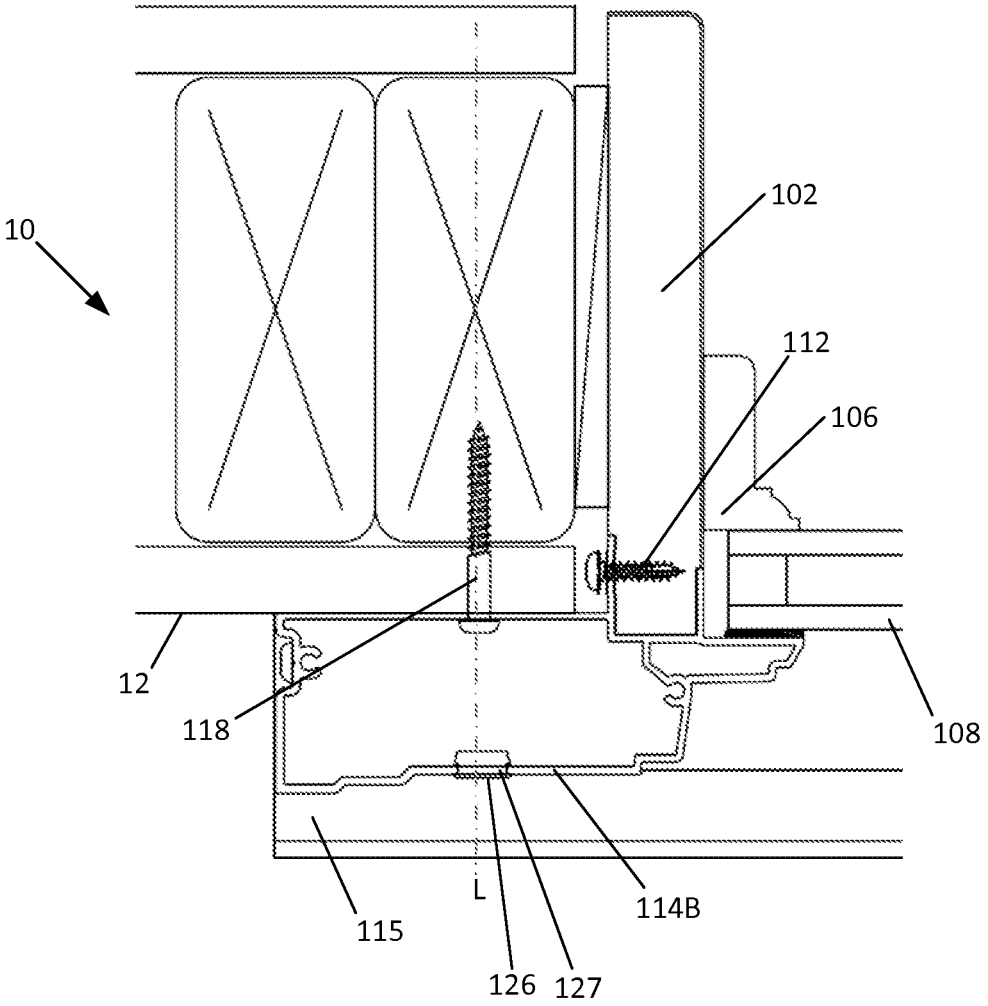
FIG. 11 is a cross-sectional view of the window assembly shown in FIG. 1 with a modified version of an exterior frame.

Referring to FIG. 11, an embodiment is shown in which the accessory support frame members 114, the exterior sash assembly frame members 110, and the accessory frame 104 are provided as an integral structure. In such an embodiment, the integrated structure can be referred to as an exterior frame 114B. The exterior frame 114B can be attached to the structure 10 with fasteners 118 which can be accessed through apertures 126. The apertures 126 can be concealed by covers or inserts 127 since there is no accessory frame which snaps over to cover the apertures 126. As with the other shown embodiments, the window assembly 100 is secured to the building structure 10 via fasteners 118 with fasteners 112 securing the base frame assembly 102 to the frame 114B, rather than having fasteners directly attaching the base frame assembly 102 to the building structure 10.

Figure 12:
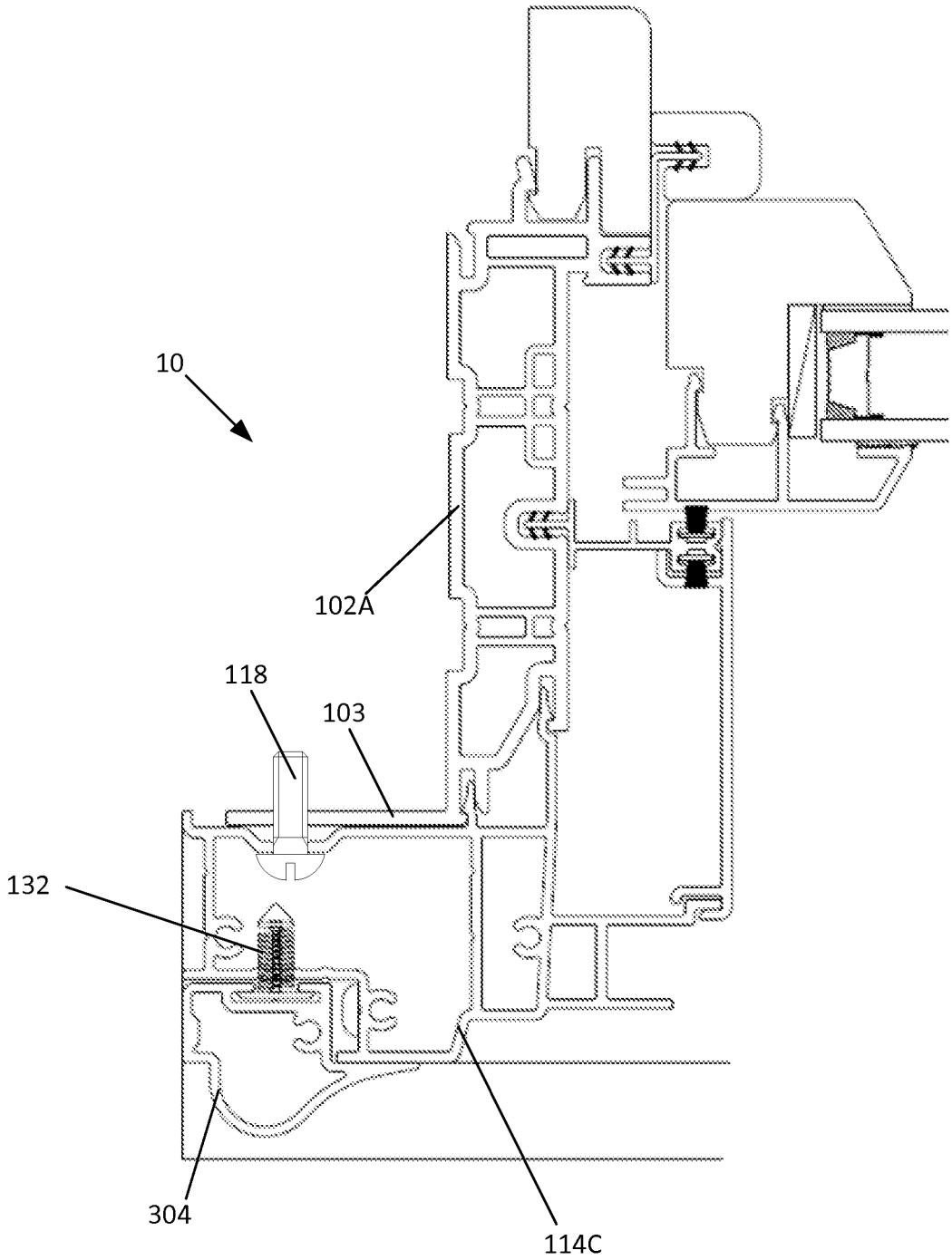
FIG. 12 is a cross-sectional view of a modular window assembly with a modified version of an exterior frame and accessory cover.

Referring to FIG. 12, an embodiment is shown in which a modular window assembly 10A is provided configured to accept the accessory frame 304. The attachment of the support frame assembly 114C to the building structure 10 and the attachment of the accessory frame 304 to the support frame assembly 114 is the same as already described for the example shown at FIGS. 9-10, and therefore need not be described further here. However, in this embodiment, the window assembly 100 is of modular construction with a base frame assembly 102A provided that is configured to accept various interior trim components 105 and the exterior accessory components 304. In this embodiment, a support frame assembly 114C is configured to engage the base frame assembly 102A in a snap fit-type arrangement rather than relying on a connection with fasteners 112. Additionally, the base frame assembly 102A is provided with a nail fin 103 which enables the base frame assembly 112 to be secured to the building structure 10 with fasteners 118. The support frame assembly 114C is also configured such that the window can be supported via the support frame assembly 114C with fasteners 118 which are then concealed by accessory frame members 304. The configuration shown in FIG. 12 is further shown and described in a U.S. provisional patent application being concurrently filed with this application 62/21,1531 and entitled VERSATILE HYBRID WINDOW SYSTEM, the entirety of which is incorporated by reference herein.

As explained previously, each provided accessory member 104*x*, 204*x*, 304*x* is configured to be attached to a corresponding base frame member 102*x* of the frame 102. As shown, each accessory member 104*x*, 204*x*, 304*x* of the frame 104 has a respective t-slot arrangement 134, 234, 334 for holding a plurality of fasteners 132 equal to the number of apertures 126 provided along a member of the accessory support frame assembly. The fasteners 132 are provided with a corresponding head 132*a* that is received by the respective t-slot arrangement 134, 234, 334. This configuration allows for the fasteners 132 to be slid along the length of the accessory member 104*x*, 204*x*, 304*x* within the slot 134, 234, 334 such that each fastener can be easily aligned with the corresponding aperture 126. This configuration also allows for the fasteners 132 to be fully concealed from view once the accessory members 104*x*, 204*x*, 304*x* are installed. The alternative arrangements shown at FIGS. 8A and 8B may also be used with any of the disclosed configurations.

In one example, the fasteners 132 are friction-type fasteners or clip fasteners, such as Christmas tree fasteners or push-in clips, respectively. As shown, the fasteners 132 are provided with a ribbed shank 132*b* that engages the material surrounding aperture 126 to secure the accessory member 104*x*, 204*x*, 304*x* to the base frame member 102*x*. As shown, the ribbed shank 132*b* has a larger dimension than the apertures 126 such that an interference or friction fit occurs when pressed into the aperture 126. After insertion, the individual ribs on a Christmas tree type fastener 132 expand beyond the opening size of the aperture 126 and provide resistance to the fastener 132 being pulled back through the aperture 126. Some of the ribs may be compressed against the shank 132*b* at the location of the aperture 126 which provides additional friction. The ribs may also be provided with an angle such that less force is required to insert the fastener 132 into the aperture 126 as compared to the force to remove the fastener 132 from the aperture. The fasteners 132 are also shown as having a conical or triangular tip section 132*c* to allow for easier initial alignment of the fastener with respect to the aperture 126. The fasteners 132 may also be formed as expansion type clips that compress as they pass through the aperture 126, and then expand to a dimension greater than that of the aperture 126 when more fully depressed through the aperture 126. The alternative arrangements shown at FIGS. 8A and 8B may also be used with any of the disclosed configurations.

In one aspect, each of the exterior accessory members 104*x*, 204*x*, 304*x* may be cut from stock material such that they all have the same cross-sectional profile. Further, stock material can be produced in lineal fashion such that many exterior accessory members can be cut from a single length of stock. Thus, the use of a single lineal profile for accessory members of the frames 104, 204, 304 results in a reduction of frame part types, part machining, and assembly time. In the exemplary embodiment shown, each of the exterior accessory members of the frames 104, 204, 304 is a painted aluminum extrusion, but may be constructed from other extrudeable, pultrudeable or roll formed materials as well, including but not limited to steel alloys, polyolefin polymers, cellular PVC (polyvinyl chloride or vinyl) polymers, cellulosic plastic composites, fiberglass composites, polymeric alloys or other extrudeable, pultrudeable and formable material.

The exterior accessory members of the frames 104, 204, 304 can be provided in many other cross-sectional shapes and sizes and are not limited to the examples presented herein. It is also noted that the exterior accessory members can be provided with different shapes within the same window assembly. For example, the bottom accessory member can be formed in the shape of a sill nose, the top accessory member can be formed in the shape of a drip cap or cornice, and the side accessory members can be formed from any number of other desired shapes, such as flat or stepped trim pieces. Additionally, the frames 104, 204, 304 can be more than three or four sided and do not necessarily have to be rectangular in shape. Other shapes are possible for the frames, for example, circular, ovular, triangular, pentagonal, hexagonal, and so on.

The window assembly 100 may also include additional trim pieces, for example jamb extenders and interior trim components. Jamb extenders function to extend the width of the base frame assembly as necessary to ensure that the base frame members and the jamb extenders extend the entire width of the rough opening for the window. The trim components can be provided in the form of head stops and sill stops. It is also noted that the built up construction of the exterior components including an accessory cover attachable to a support frame more easily lend themselves to bending for curved window applications, in comparison to similarly shaped profiles where the entire exterior is a single component. Large width profiles are difficult to bend as the internal structures are prone to collapse with the large resulting difference between inside and outside radii. However, the disclosed embodiments using separable accessory covers and support frames can be individually bent and then assembled to form a wider assembled profile.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

What is claimed is:

1. A window assembly for installation into an opening of a building structure, the window assembly comprising:

(a) a window assembly including a window pane extending along a first plane;

(b) a base frame supporting the window assembly, the base frame having an outer surface orthogonal to the first plane and defining an outer perimeter;

(c) a support frame connected to the base frame and extending away from the outer perimeter in a direction parallel to the first plane, the support frame including interior and exterior portions being parallel to the first plane and defining an internal cavity therebetween;

(d) an accessory frame connected to the support frame;

(e) a plurality of first fasteners securing the support frame interior portion to the building structure, the first fasteners extending in a direction orthogonal to the first plane;

(f) a plurality of second fasteners securing the accessory frame to the support frame exterior portion, the plurality of second fasteners being separately formed from the accessory frame and support frame; and (g) wherein the accessory frame conceals the interior cavity, the plurality of first fasteners, and the plurality of second fasteners such that heads of the first fasteners are located between the the interior and exterior portions of the support frame.

2. The window assembly of claim 1, wherein the plurality of second fasteners are one of push-in type clips and friction-type fasteners.

3. The window assembly of claim 2, wherein each of the plurality of second fasteners is provided with a shank and a head and wherein the accessory frame includes at least one frame member having a longitudinal slot configured to slidingly receive the fastener head to allow each of the plurality of second fasteners to be aligned with a corresponding aperture in the support frame.

4. The window assembly of claim 2, further comprising:

(a) a plurality of third fasteners securing the support frame to the base frame.

5. The window assembly of claim 1, wherein the support frame is connected to the base frame without the use of separate mechanical fasteners.

6. The window assembly of claim 1, wherein one or more of the base frame, support frame, and accessory frame is formed from extruded members having a uniform profile.

7. A window assembly for installation into an opening of a building structure, the window assembly comprising:

(a) a window assembly including a window pane extending along a first plane;

(b) a base frame supporting the window assembly, the base frame having an outer surface orthogonal to the first plane and defining an outer perimeter;

(c) a support frame connected to the base frame and extending away from the outer perimeter in a direction parallel to the first plane, the support frame including parallel interior and exterior portions defining an internal cavity therebetween, the support frame defining one or more mounting locations, at the interior portion, through which fasteners can extend to secure the support frame to the building structure;

(d) an interior trim assembly connected directly to the base frame; and (e) an accessory frame connectable to the support frame at the exterior portion with a plurality of fasteners separately formed from the accessory frame and the support frame, the accessory frame, when connected to the support frame, concealing the internal cavity and the one or more mounting locations from view from an exterior side of the window assembly.

8. The window assembly of claim 7, further comprising:

(a) a plurality of first fasteners for securing the support frame to the building structure, wherein when the first fasteners are installed, the first fasteners extend in a direction orthogonal to the first plane and heads of the first fasteners are concealed by the accessory frame such that the heads are located between the accessory frame and the one or more mounting locations.

9. The window assembly of claim 8, further comprising:

(a) a plurality of second fasteners for securing the accessory frame to the plurality of first fasteners, the second fasteners being aligned parallel to the first fasteners.

10. The window assembly of claim 9, wherein the plurality of second fasteners are one of push-in type clips and friction-type fasteners.

11. The window assembly of claim 9, wherein each of the plurality of second fasteners is provided with a shank and a head and wherein the accessory frame includes at least one frame member having a longitudinal slot configured to slidingly receive the fastener head to allow each of the plurality of second fasteners to be aligned with a corresponding aperture in the support frame.

12. The window assembly of claim 9, further comprising:

(a) a plurality of third fasteners for securing the support frame to the base frame.

13. The window assembly of claim 7, wherein the support frame is connectable to the base frame without the use of separate mechanical fasteners.

14. The window assembly of claim 7, wherein one or more of the base frame, support frame, and accessory frame is formed from extruded members having a uniform profile.

15. A method of installing a window assembly comprising:

(a) providing a base frame including a plurality of base frame members that form a frame retaining at least one window pane extending along a first plane;

(b) providing an accessory support frame including interior and exterior portions being parallel to the first plane and defining an internal cavity therebetween;

(c) connecting the accessory support frame to the base frame;

(d) inserting the assembled base frame and accessory support frame into an opening in a wall of a building structure;

(e) attaching the accessory support frame to the building structure with a first plurality of fasteners;

(f) selecting an exterior accessory frame from a plurality of differently shaped exterior accessory frames; and (g) attaching the selected exterior accessory frame to the accessory support frame exterior portion via a second plurality of fasteners, separately formed from the accessory support frame and the exterior accessory frame, such that the exterior accessory assembly conceals the internal cavity, the first plurality of fasteners and the second plurality of fasteners once the exterior accessory assembly is connected to the base frame assembly.

16. The method of installing a window assembly of claim 15, wherein the step of selecting an exterior accessory frame includes selecting an exterior accessory frame having at least one longitudinal slot for retaining one or more fasteners.

17. The method of installing a window assembly of claim 15, wherein the step of selecting an exterior accessory frame includes selecting fasteners that are friction-type or push-in type fasteners.

18. The method of installing a window assembly of claim 15, wherein the step of attaching the selected exterior accessory frame to the accessory support frame includes aligning each of the second plurality of fasteners with one of the first plurality of fasteners.

* * * * *